US005467098A

United States Patent [19]

Bonebright

[11] Patent Number: 5,467,098

[45] **Date of Patent: * Nov. 14, 1995**

[54] TRANSMISSION LINE NOTCH ANTENNA

[75] Inventor: Mark E. Bonebright, La Mesa, Calif.

[73] Assignee: McDonnell Douglas Corporation, Huntington Beach, Calif.

[ * ] Notice: The portion of the term of this patent subsequent to Sep. 5, 2012, has been disclaimed.

[21] Appl. No.: 347,991

[22] Filed: Dec. 2, 1994

Related U.S. Application Data

[63] Continuation of Ser. No. 50,873, Apr. 20, 1993, abandoned.

[51] Int. Cl.[6] ..... H01Q 13/10

[52] U.S. Cl. ..... 343/767; 343/749; 343/752; 343/795; 343/797

[58] Field of Search ..... 343/741, 767, 343/792.5, 795, 797, 749, 752; H01Q 13/10

[56] References Cited

U.S. PATENT DOCUMENTS 3,007,164 10/1961 Davis ..... 343/767 X 4,500,887 2/1985 Nester ..... 343/795 X

*Primary Examiner*—Donald T. Hajec
*Assistant Examiner*—Steven Wigmore
*Attorney, Agent, or Firm*—George W. Finch

[57] ABSTRACT

Non-resonant, end fire antennae that operate over broad frequency bands, can be incorporated into arrays and have low RF cross-sections are constructed from a transmission line, usually a piece of coaxial cable that if it is not self supporting, is mounted on or in a lightweight structural material with an outer end with a sheath or stripline the shape of half of a notch. The other half of the notch is formed from a conductor electrically connected to the center conductor of the coaxial cable. The cable and conductor are variably spaced to transition the characteristic impedance of the cable to that of free space. The conductor and the sheath are terminated either with ground connections or by inductive loads.

32 Claims, 5 Drawing Sheets

FIG. 10.
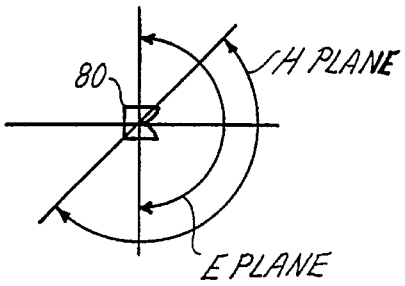
FIG. 11.
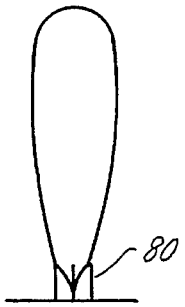
FIG. 12.
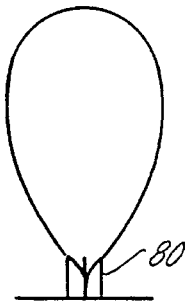
FIG. 14.
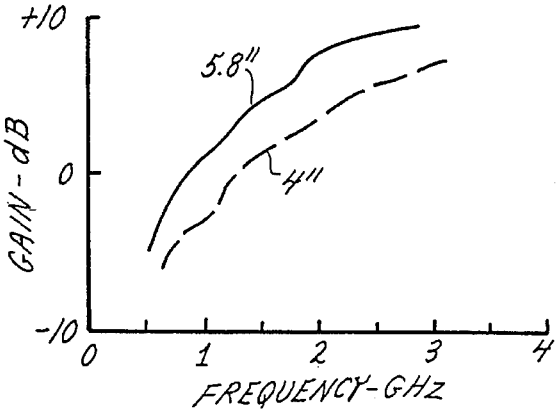
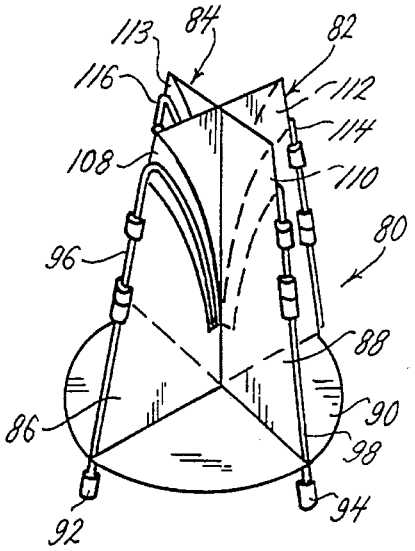
FIG. 15.
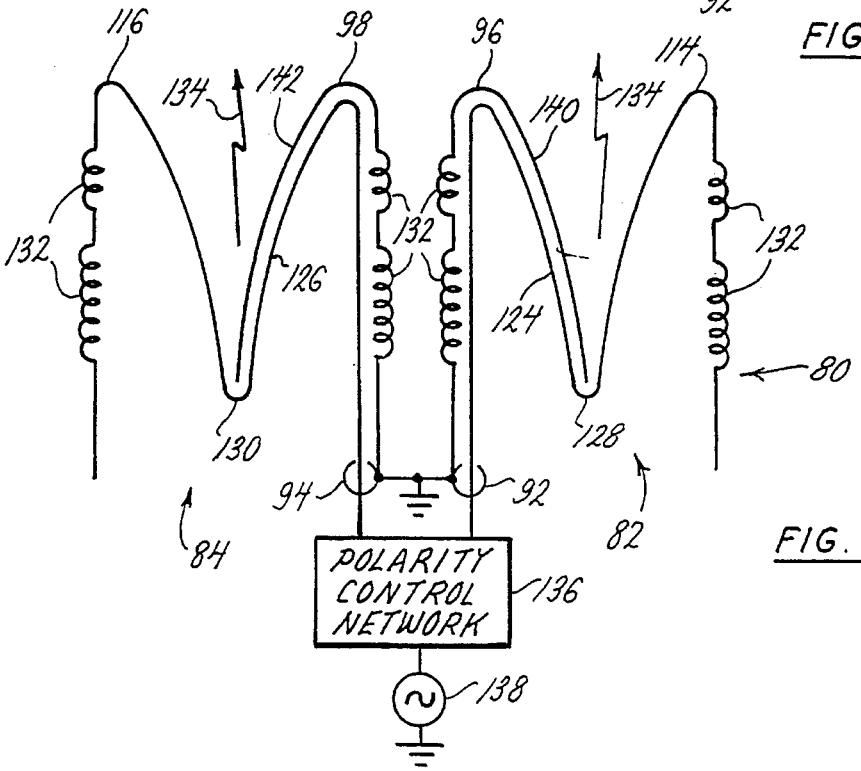
FIG. 13.

FIG. 21.
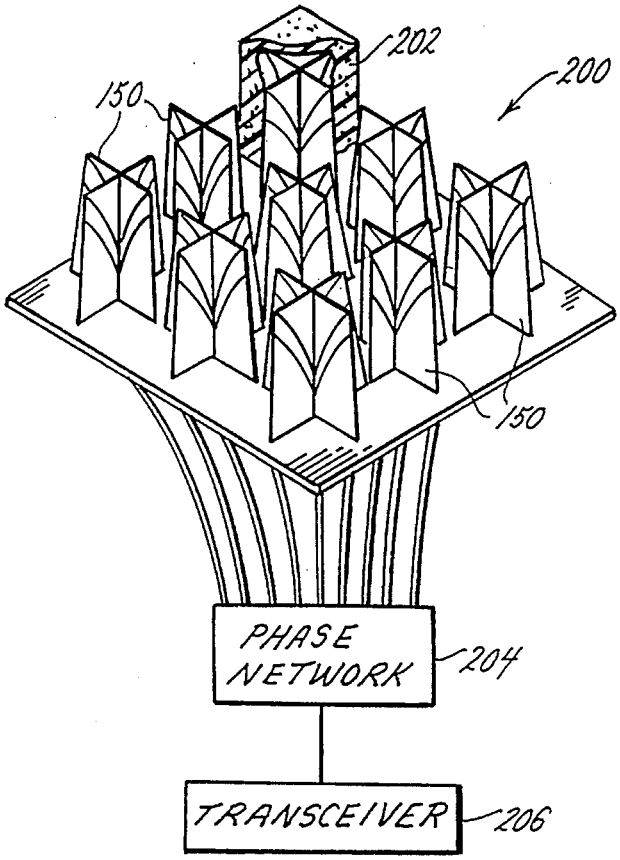
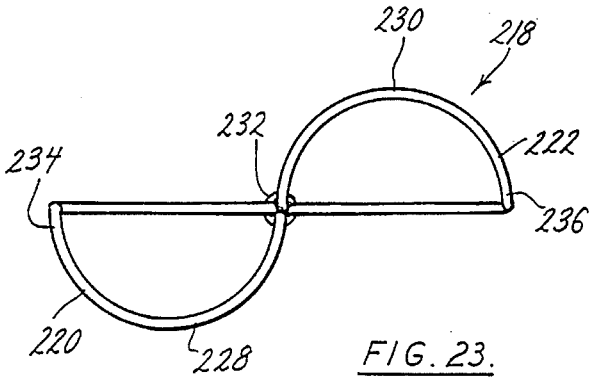
FIG. 23.
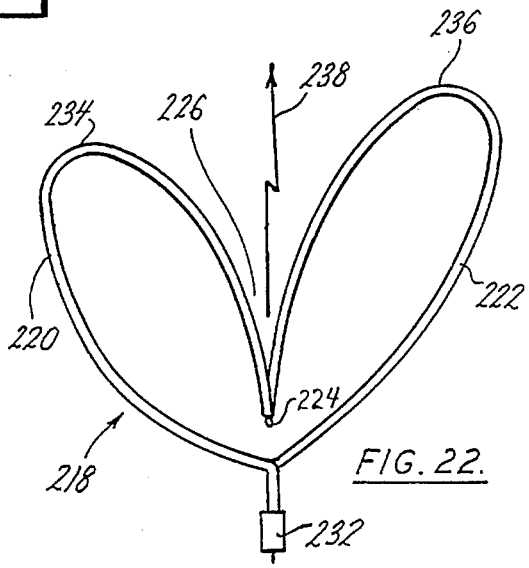
FIG. 22.

TRANSMISSION LINE NOTCH ANTENNA

This is a continuation of application Ser. No. 08/050,873, filed on Apr. 20, 1993, now abandoned.

FIELD OF THE INVENTION

This invention relates to non-resonant antennae that operate over broad frequency bands, can be incorporated into arrays and have low RF cross-sections.

BACKGROUND OF THE INVENTION

Stripline fed notch antennae have been known as wide band array elements since the 1970's. A history of such antennae is contained in a paper entitled "Endfire Slotline Antennas" which was presented at JINA '90, Nice, France, 13–15 Nov. 1990, by Daniel H. Schaubert. Elements making up such antennae usually take the form of a planar structure with two conductors flared from a common feed point or "notch" linearly, exponentially or according to any other reasonable curve, including curves with discontinuities. These elements can be used to produce antennae with wide variations in characteristics. Generally, such antennae elements are fed at the base of the notch, which is sized to match the impedance of the transmission line thereto. The conductors spread apart to gradually increase the effective impedance until it matches the free space impedance in air. In essence, the antennae act like impedance matching transformers to launch radio frequency energy from a transmission line into free space. The antennae elements are commonly constructed using photolithographic fabrication techniques on printed circuit board material. This allows their shape and size to be precisely controlled. Such antennae elements are readily combined into arrays that are useful in radio astronomy instrumentation, remote sensing, multiple beam satellite communications, and special power combining and phased arrays. At microwave frequencies, endfire slotline antennae have been used for wide bandwidth scanning arrays, and appear useful for radar and electronic warfare systems, as well as multifunction antennae apertures.

The most common method of feeding endfire slotline antennas in the microwave frequency regime, is with a microstrip or stripline. Both feed methods have advantages and disadvantages and both work on the principle of the following described microstrip to slot transition, in which quarter-wave length open circuited strip is used to reflect a short circuit to the region of the slotline, feeding a maximum of the current standing wave in the region where the slot interrupts the ground plane current. This results in maximum coupling between the lines. The quarter wave length short circuited slotline stub reflects an open circuit to the region of the stub, so that all of the coupled power travels off along the slotline of characteristic impedance and then to the antenna. Unfortunately, this take a lot of real estate and provides a relatively large area of metalization, which if in a radar environment, reflects substantial amounts of RF-radiation. Therefore, it has been desired to develop robust endfire antennas that have a minimum of reflective metal, are of minimal size, usually not much bigger than the length of the notch in height, and which can be used as broad band elements in almost a limitless array with minimal radar cross-section.

BRIEF DESCRIPTION OF THE INVENTION

The present invention is an endfire slot antenna, which can be constructed almost entirely from the transmission line needed to feed it. In a basic antenna element configuration, a piece of coaxial cable is mounted on or in a lightweight planar material, such as a dielectric foam sheet, having upper, lower, and two side edges. The coaxial cable is extended from the center of and along the bottom edge of the planar sheet. The cable is curved into a 90° bend at a first side edge and extended from the bottom edge to the top edge along the first side edge. When the coaxial cable approaches the upper edge, it is curved into a typical endfire slot antennae curve, which extends back toward the center of the bottom edge of the sheet to form half of a notch. The center conductor of the coaxial cable is connected to a conductor of similar size and reverse shape at the bottom of the notch. The conductor preferably has the same diameter as the sheath of the coaxial cable and forms the opposite side of the notched slot antenna element, extending back to the sheath adjacent to the center of the bottom edge of the sheet. In this manner, a minimum of metallic, RF reflecting material is exposed since, in fact, the antenna elements are mostly the transmission line otherwise required to feed a notched slot antenna. If the coaxial cable and conductor are self supporting, the planar sheet can be eliminated. When self supporting coaxial cable and conductor are used, they may be spiralled as they extend down into the notch to assure circular polarity of the antenna without resort to multiple connections and matching networks.

A microstrip or stripline transmission line can be substituted for the coaxial cable and conductor forming the notch. The result is an antenna element that is very producible, low RF reflecting, and low-cost. In essence, the antenna element is a transmission line with a special shape that allows it to act as an antenna with a minimum amount of non-radiating, RF reflecting structural material.

It is therefore an object of the present invention to provide a matched twin lead notched radiating slot element for use as a low cross-section broadband antenna.

Another object is to provide a notch antenna with minimum non-radiating RF reflecting structural material.

Another object is to provide a low radar cross-section, economic, broadband antenna, which can be designed for use in many frequency bands, can be fabricated to have circular or other polarity, and can be constructed without special tools or equipment.

These and other objects and advantages of the present invention will become apparent to those skilled in the art after considering the following detailed specification, together with the accompanying drawings, wherein

BRIEF DESCRIPTION OF THE DRAWINGS

FIG. 10 is an orientation diagram showing the E-plane and H-plane of the antenna of FIG. 8;

FIG. 11 shows the E-plane antenna pattern for the antenna of FIG. 8;

FIG. 12 shows the H-plane antenna pattern for the antenna of FIG. 8;

FIG. 13 is an equivalent electrical diagram of the antenna of FIG. 8 when fed with a polarity control network such as con be used when circular or other polarity is desired;

FIG. 14 is a graph of gain versus frequency for antennae of FIG. 8 with 4 inch and 5.8 inch apertures;

FIG. 15 is a perspective view of the antenna of FIG. 8;

FIG. 21 is a perspective view of antennae of FIG. 16 combined into an array;

FIG. 22 is a side view of a three dimensional spiral version of the antenna element of FIG. 1; and FIG. 23 is a top view of the antenna of FIG. 22.

DETAILED DESCRIPTION OF THE SHOWN EMBODIMENTS

Figure 1:
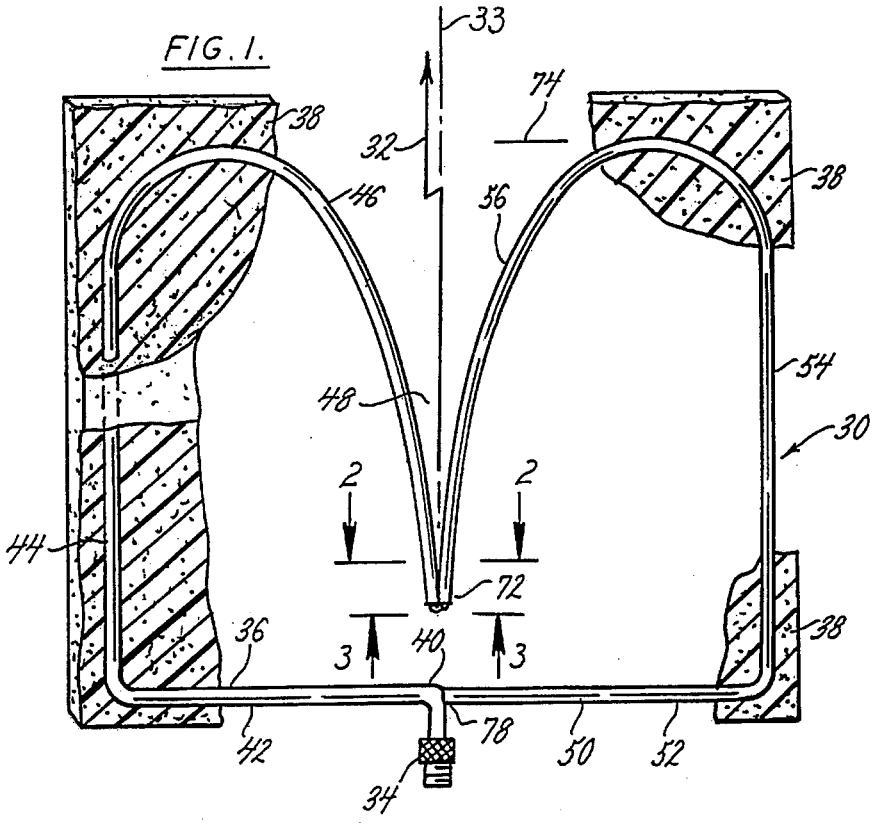
FIG. 1 is a side elevational view of a transmission line notch antenna element constructed according to the present invention.

Referring to the drawings more particularly by reference numbers, number 30 in FIG. 1 refers to a notch antenna element constructed according to the present invention. Such antenna elements 30 are endfire types, which in the transmitting mode, radiate RF energy in the direction shown by the arrow 32 along the center line 33 of the element 30. The element 30 is connected to a transmitter or receiver by means of a connector 34 and is constructed of a minimum amount of RF reflecting material. The element 30 includes a shaped piece of coaxial cable 36. If the cable 36 is not self supporting, its shape can be maintained by mounting it on or in dielectric materials, such as the dielectric foam sheet 38 shown. The coaxial cable 36 extends generally perpendicular to the direction of radiation 32 from the lower center 40 of the sheet 38 in a sidewardly running portion 42, and then extends upwardly parallel to the direction of radiation 32 for a portion 44, which then transitions into a curved portion 46 forming half of an antenna notch 48.

Figure 2:
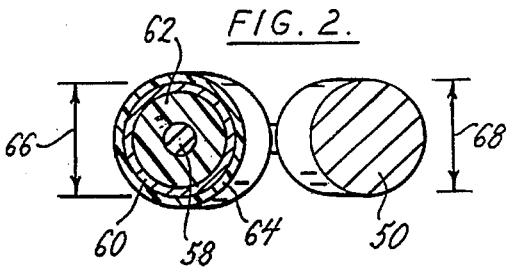
FIG. 2 is an enlarged cross-sectional view taken at line 2—2 of FIG. 1.
Figure 3:
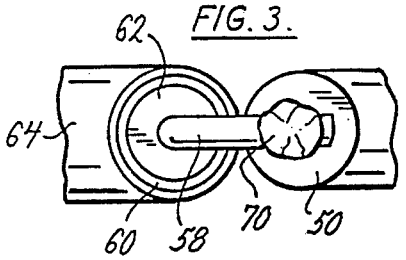
FIG. 3 is an enlarged view taken at line 3—3 of FIG. 1 showing the connection between the coaxial cable and the conductor of the present invention.

A conductor 50 forms the other half of the antenna element 30 and includes a lower portion 52 in general alignment with portion 42, an upstanding portion 54 generally parallel to portion 44, and a curved portion 56, which is generally a mirror image of curve portion 46. However, some asymmetry can be used to improve antenna performance, particularly in larger antennae that operate at lower frequencies where slight impedance mismatches can otherwise reflect and undesirably combine in phase in the notch 48. As shown in FIG. 2, the coaxial cable 36 includes a center conductor 58 separated from a conducting sheath 60 by a dielectric filler 62. Such cables 36 also commonly include an insulating cover 64 surrounding the sheath 60 although in this application, such insulating cover 64 is not required. The outer diameter 66 of the sheath 60 and the outer diameter 68 of the conductor 50 are similar, so that the externally, the antenna element 30 appears bilaterally symmetrical. As shown in FIG. 3, the center conductor 58 is electrically connected to the conductor 50, such as by solder 70 at the inner most tip 72 of the notch 48, providing RF feed thereat.

Figure 4:
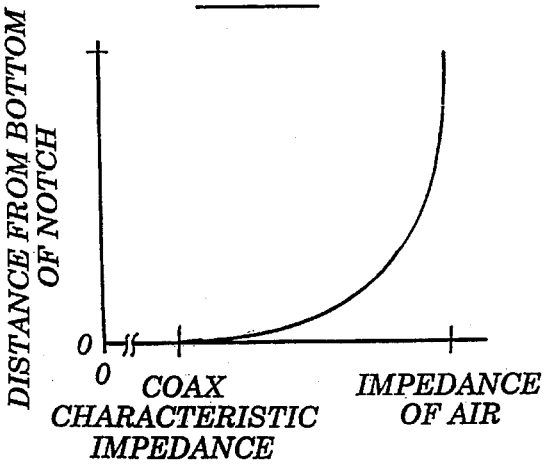
FIG. 4 is a graph of the exponential transition of the characteristic impedance of the coaxial cable to air provided by the antennas element of FIGS. 1 through 3.
Figure 5:
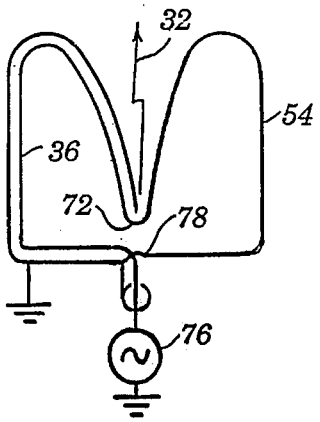
FIG. 5 is an electrical equivalent diagram of the antenna element of FIG. 1.

Although the operation of endfire notch antennae is not fully understood, it appears that they operate by gradually transitioning the characteristic impedance of an RF transmission line such as the coaxial cable 56, to the characteristic impedance of air. RF energy radiates from the tip 72 out of the notch 48 or as RF energy is received from the air to the coaxial cable 36. This is shown in the graph of FIG. 4, which plots characteristic impedance versus distance from the tip 72 of the notch 48 where the characteristic impedance is that of the coaxial cable 36 to the end 74 of the element 30 where the characteristic impedance is that of air (free space). The curvature of the curved portions 46 and 56 shown in FIG. 1 is used to produce an exponential impedance matching curve particularly desirable when a broadband antenna element 30 is needed. However, the curved portions 46 and 56 can be formed with other curvatures such as those used in notched slot antennas of the prior art to produce circular, hyperbolic, cosecantial, or even linear impedance matching curves, just to name a few. The electrical equivalent diagram of the antenna 30, when operating as a transmitting antenna, is shown in FIG. 5 wherein an RF transmitter 76 is connected between ground and the center conductor, whereas the sheath 60 and the conductor 50 are grounded. Note that the end 78 of the conductor 50 opposite from the point 72, is connected to the sheath 60 closely spaced from the connector 34 whereas the sheath 60 is insulated from the conductor 50 at the tip 72 (FIG. 1).

Figure 6:
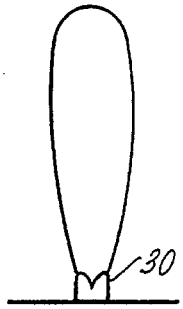
FIG. 6 is the E-plane antenna pattern for the antenna element of FIG. 1.
Figure 7:
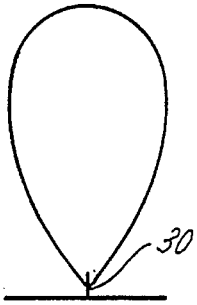
FIG. 7 is the H-plane antenna pattern for the antenna element of FIG. 1.

Typical E-plane and H-plane antenna patterns of the antenna element 30 are shown in FIGS. 6 and 7. The E-plane being generally in the plane of the antenna element 30, whereas, the H-plane being at right angles thereto.

Figure 8:
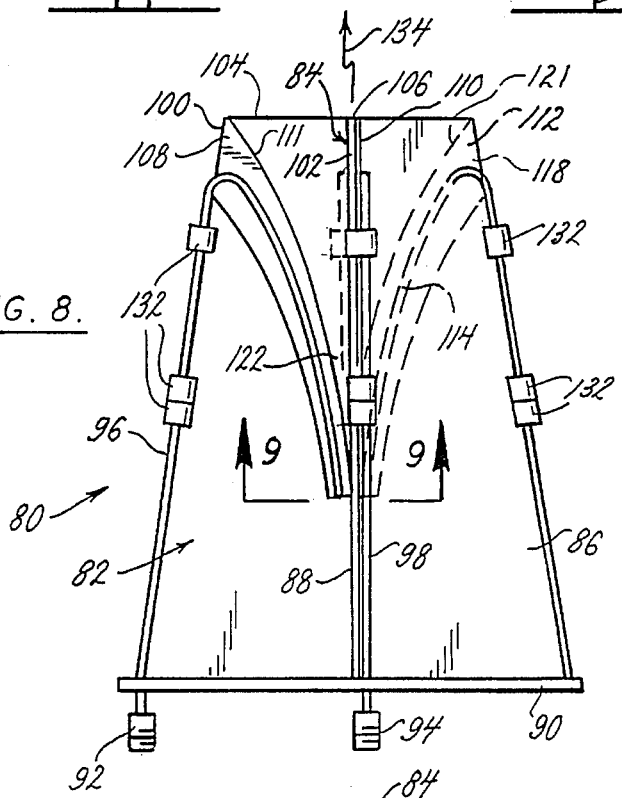
FIG. 8 is a side elevational view of a modified version of the present invention, using two antenna elements positioned at right angles to each other.

An antenna 80 constructed from elements 82 and 84, similar to but slightly modified from antenna element 30, is shown in FIG. 8, the elements 82 and 84 being positioned at right angles to each other and being essentially electrically identical. Each element 82 or 84 includes a dielectric planar support 86 or 88, which supports 86 and 88 extend perpendicular to each other and perpendicular from a base 90, which may be a conducting ground plane, a non-conducting sheet, or not present at all. Each element 82 and 84, when used in a transmit mode, is fed RF energy through a connector 92 or 94 into a coaxial cable 96 or 98. The cables 96 and 98 extend up an outer edge 100 or 102 of the dielectric supports 86 and 88, respectively. When the coaxial cables 96 and 98 approach the top edges 104 and 106 of the dielectric supports 86 and 88, they curve and run centrally alongside curved conductive strips 108 and 110, strip 110 being shown in FIG. 9. The inner edges (inner edge 111 of strip 108 being shown in FIG. 8) of the conductive strips define halves of the notches of each antenna element 82 or 84.

The opposite side edges, side edge 112 of dielectric sheet 86 being shown while edge 113 is hidden there behind, have conductors 114 and 116 running there along. When the conductors 114 and 116 approach the upper edges 104 and 106 of the dielectric supports 86 and 88, they curve downwardly with shapes that generally mirror image the coaxial cables 96 and 98, and being generally centered within conductive strips 118 and 120, which are generally mirror images of conductive strips 108 and 110, and whose inner edges (inner edge 121 of strip 118 being shown in FIG. 8) define the other halves of the radiating notches therewith, notch 122 of element 82 being shown.

Figure 9:
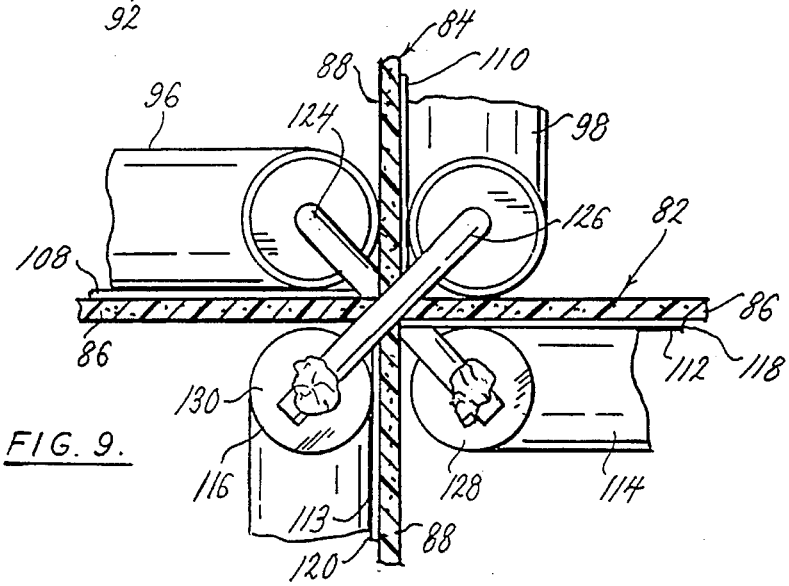
FIG. 9 is an enlarged cross-sectional view taken at line 9—9 in FIG. 8.
Figure 16:
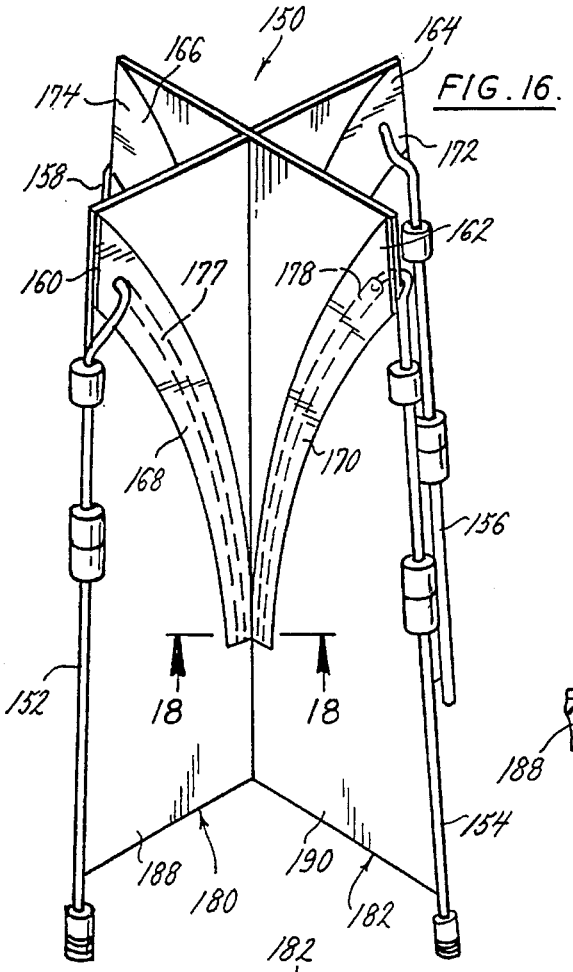
FIG. 16 is a perspective view of a modified version of the antenna of FIG. 8 using stripline transformers as portions of its antenna feed.

As can be seen in FIG. 9, the center conductors 124 and 126 of the cables 96 and 98 are soldered to the ends 128 and 130 of the conductors 114 and 116. Loads suitable to the frequencies involved and shown as distributed ferrite loads 132 in the form of ferrite rings are placed around the coaxial cables 96 and 98 and conductors 114 and 116 at the side edges 100, 102, 112, and 113 to absorb RF energy thereat, and reduce spurious radiation. The antenna 80 radiates in the direction shown by arrow 134.

FIG. 10 is a diagrammatic view showing the orientation of the E-plane and the H-plane of antenna 80, whereas FIGS. 11 and 12 show the E-plane and H-plane antenna patterns, respectively.

FIG. 13 is an electrical diagram of antenna 80 connected to a polarity control network 136 driven by an RF transmitter 138 or connected to a receiver should the antenna 80 be used for such purpose. The polarity control network 136 can be used to vary the magnitude and/or phase of RF signals applied to or received from each element 82 and 84 to adjust its polarity. As can be seen, although the conductive sheaths 140 and 142 of coaxial cables 96 and 98 are grounded through the connectors 92 and 94, the conductors 114 and 116 are connected to the center conductors 124 and 126 of the coaxial cables 96 and 98 at their ends 128 and 130, but are otherwise unconnected. The result is a cross, dual-polarization, notch fed antenna 80. Although the conductive strips 108, 110, 118 and 120 can be placed on one side of the dielectric support 86, they can also be placed in pairs on both sides of the dielectric supports 86 and 88 in a sandwich configuration.

Figure 17:
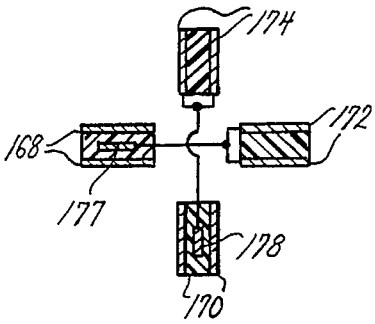
FIG. 17 is a circuit diagram of the electrical connections at the base of the notch of the antenna of FIG. 16.
Figure 18:
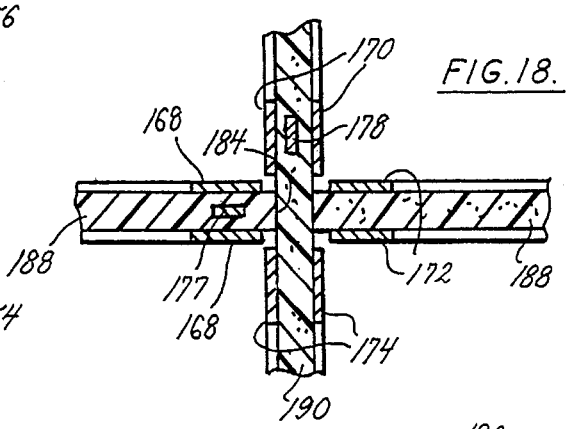
FIG. 18 is an enlarged cross-sectional view taken at line 18—18 of FIG. 16.

Modified antenna 150 is similar to antenna 80, except that the coaxial cables 152 and 154 and the conductors 156 and 158 thereof, end adjacent the upper edges 160, 162, 164 and 166 of strip pairs 168, 170, 172 and 174. The conductors 156 and 158 connect to the strip pairs 172 and 174 at the upper ends 164 and 166 thereof, whereas the sheaths of coaxial cables 154 and 156 connect to the upper ends 160 and 162 of strip pairs 168 and 170. The center conductors of the cables 154 and 156 connect to striplines 177 and 178 respectively. The striplines 177 and 178 are sandwiched between but insulated from the strip pairs 168 and 170 respectively to form 50 to 100 Ohm impedance matching transformers. The connections of the striplines 177 and 178 to the strip pairs 172 and 174 are similar to that of antenna 80 and are shown in FIG. 17, whereas the details of the striplines 177 and 178 are shown in FIG. 18.

Figure 20:
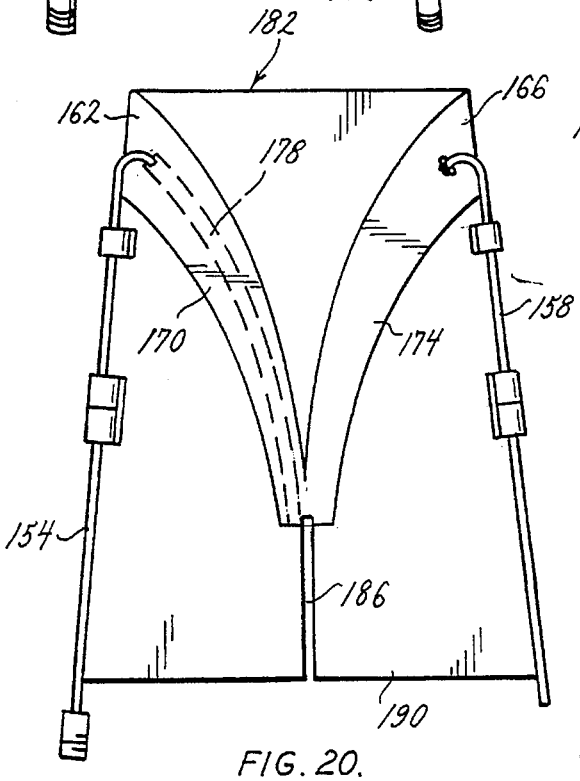
FIG. 20 is a side elevational view of the other element of the antenna of FIG. 16.
Figure 19:
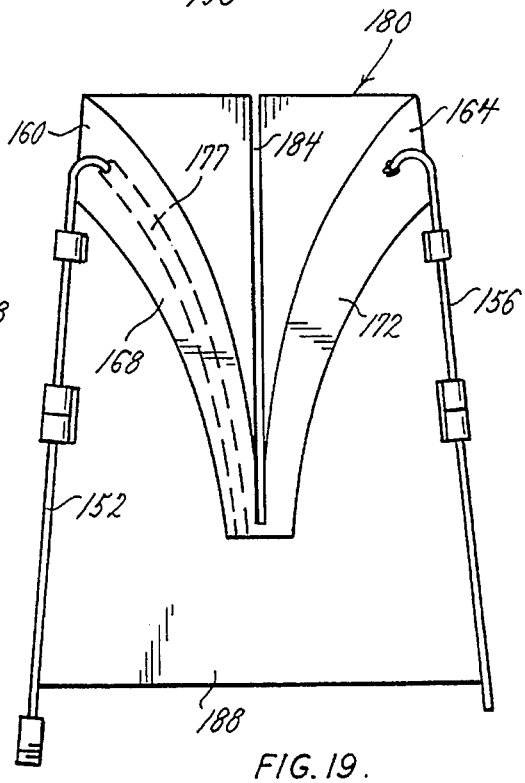
FIG. 19 is a side elevational view of one element of the antenna of FIG. 16.

FIGS. 19 and 20 show details of the construction of the elements 180 and 182 making up antenna 150, including slots 184 and 186 cut in the supporting sheets 188 and 190. The elements 180 and 182 can be assembled much like cardboard dividers by sliding slot 186 down into slot 184.

As shown in FIG. 21, antenna elements 30, and antennas 80 or 150 can be combined into an array 200 which may not be potted in a dielectric structural material such as foam 202. When the antennas, antennas 150 being shown, are arrayed, electrical connections thereto are brought out to a suitable phase network 204 which is used to steer or adjust the far field polarity of the array 200 by varying the magnitude and/or phase of the signals transmitted to or received by the antennas 150, by means such as the transceiver 206 shown.

As shown with the antenna 218 of FIGS. 22 and 23, although the antennae 80 and 150 and element 30 are shown as being generally planar, when self supporting cable 220 and conductor 222 are used, they can be spiraled 90° as they extend from the tip 224 of the notch 226. The curvature of the curved portions 228 and 230 are more difficult to calculate and form because the change in characteristic impedance is a function of the three dimensional spacing of the curved portions 228 and 230. Antenna 218 produces circular polarization without need for two elements and a feed network, all RF energy being passed through the single connector 232. Note that the curved portion 230 of the conductor 222 is slightly larger than the curved portion 228 of the coaxial cable 220 to reduce the effect of any impedance mismatch at the outer ends 234 and 236 thereof. When used as a transmitting antenna 218, RF energy 238 radiates out of the notch 226 as shown. Non-self supporting transmission lines and conductors can also be configured in spirals, but the complexity of construction of a dielectric support structure increases costs unless built in a substantial production run.

Thus, there has been shown and described novel broadband notch antennas, which fulfill all of the objects and advantageous sought therefore. Many changes, alteration, modifications and other uses and applications of the subject antennas and antenna elements will become apparent to those skilled in the art after considering this specification, together with the accompanying drawings. All such changes, alterations, and modifications which do not depart the spirit and scope of the invention are deemed to be covered by the invention, which is limited only by the claims which follow:

What is claimed is:

1. An antenna element (30) including: a transmission line (36) having:

a conductive layer (60);

a conductive member (58) adjacent said conductive layer; and dielectric spacing means (62) between said conductive layer and said conductive member, said transmission line further having:

a first transmission line end (34) for connection to RF means;

a second transmission line end (72);

a transmission line connecting portion (42 & 44) extending from said first transmission line end; and a transmission line notch portion (46) extending from said second transmission line end to said transmission line connecting portion; and a conductor (50) having:

a first conductor end (78);

a second conductor end (72);

a conductor connecting portion extending from said first conductor end (52 & 54); and a conductor notch portion (56) extending from said second conductor end to said conductor connecting portion, said transmission line notch portion is shaped in a first curve extending from said second transmission line end and said conductor notch portion is shaped in a second curve that is generally a mirror image of said first curve extending from said second conductor end, an RF energy field is set up across said transmission line notch portion and said conductor notch portion, said conductive member at said second transmission line end being electrically connected to said second conductor end so that said transmission line notch portion of said conductive layer and said conductor notch portion of said conductor form a RF active notch structure (from 72 to 74) for radiating said RF energy field in a direction away from said RF active notch structure and for transitioning the characteristic impedance of said transmission line to that of air.

2. The antenna element as defined in claim 1 further including:

dielectric means for supporting said transmission line and said conductor in a plane.

3. The antenna element as defined in claim 1 wherein said transmission line notch portion (228) and said conductor notch portion (230) define a center line (33) of said antenna element, each being spiraled about said connection of said conductive member and said second conductor end in the same direction about said center line, whereby said antenna element spirals about 90° to produce circular polarization.

4. The antenna element as defined in claim 1 wherein said conductive layer is a conductive sheath having an effective electrical outer diameter and said conductor has a similar effective electrical outer diameter.

5. The antenna element as defined in claim 1 wherein said conductive layer is connected to said first conductor end near said first transmission line end.

6. The antenna element (180) as defined in claim 1 wherein said transmission line notch portion and said conductor notch portion produce exponentially varying impedance that gradually matches the characteristic impedance of said transmission line to that of free space.

7. The antenna element as defined in claim 1 wherein said RF active notch structure includes:

a center line generally oriented equally spaced from said transmission line notch portion and said conductor notch portion, said transmission line connecting portion being comprised of:

a first subportion (42) extending adjacent said first end outwardly perpendicular to said center line; and a second subportion (44) connected to said first subportion spaced from said first end and extending generally parallel to said center line, and said conductor connecting portion being comprised of:

a third subportion (52) extending adjacent said first end outwardly perpendicular to said center line and in general alignment with said first subportion; and a fourth subportion (54) connected to said third subportion spaced from said first end and extending generally parallel to said center line and said second subportion.

8. The antenna element as defined in claim 1 wherein said transmission line has:

at least one load there on at said transmission line connecting portion thereof, and wherein said conductor has:

at least one load there on at said conductor connecting portion thereof.

9. The antenna element as defined in claim 1 wherein said conductive layer of said transmission line notch portion is comprised of:

at least one conductive transmission line planar sheet (168) defining a transmission line portion of said RF active notch structure, wherein said conductive member of said transmission line notch portion includes:

at least one conductive planar strip (177) positioned parallel to said at least one conductive transmission line planar sheet and closely spaced thereto, and wherein said conductor notch portion includes:

at least one conductive conductor planar sheet (172) defining a conductor portion of said RF active notch structure.

10. The antenna element as defined in claim 1 further including:

a planar dielectric layer for supporting said transmission line and said conductor in a plane, said planar dielectric layer having:

first and second opposite parallel sides, and wherein said conductive layer of said transmission line notch portion is a first conductive transmission line conductive sheet mounted on said first side of said planar dielectric layer, said element further including:

a second conductive transmission line planar positioned on said second side of said planar dielectric layer, each conductive transmission line planar sheet having:

a transmission line edge defining a transmission line portion of said RF active notch structure, wherein said conductive member of said transmission line notch portion includes:

at least one conductive planar strip parallel to said conductive transmission line planar sheets and closely spaced therebetween, and wherein said conductor notch portion includes:

first and second conductive conductor planar sheets positioned on said first and second opposite parallel sides of said planar dielectric layer respectively, each conductive conductor planar sheet having:

a conductor edge defining a conductor portion of said RF active notch structure.

11. An antenna (80) including:

a first antenna element (82) having:

a transmission line having:

an conductive layer (108);

a conductive member (124) within said conductive layer; and dielectric spacing means (188) between said conductive layer and said conductive member, said transmission line further having:

a first transmission line end (92) for connection to RF means;

a second transmission line end (128);

a transmission line connecting portion extending from said first transmission line end (96); and a transmission line notch portion (108) extending from said second transmission line end to said transmission line connecting portion; and a conductor having:

a second conductor end (128); and a conductor notch portion (120) extending from said second conductor end, said transmission line notch portion is shaped in a first curve extending from said second transmission line end and said conductor notch portion is shaped in a second curve that is generally a mirror image of said first curve extending from said second conductor end, an RF energy field is set up across said transmission line notch portion and said conductor notch portion, said conductive member at said second transmission line end being electrically connected to said second conductor end so that said transmission line notch portion of said conductive layer and said conductor notch portion of said conductor form an RF active notch structure for radiating said RF energy field in a direction away from said RF active notch structure and for transitioning the characteristic impedance of said transmission line to that of air; and a second antenna element (82) having:

a transmission line having:

an conductive layer;

a conductive member within said conductive layer; and dielectric spacing means between said conductive layer and said conductive member, said transmission line further having:

a first transmission line end for connection to RF means;

a second transmission line end;

a transmission line connecting portion extending from said first transmission line end; and a transmission line notch portion extending from said second transmission line end to said transmission line connecting portion; and a conductor having:

a second conductor end; and a conductor notch portion extending from said second conductor end, said transmission line notch portion is shaped in a first curve extending from said second transmission line end and said conductor notch portion is shaped in a second curve that is generally a mirror image of said first curve extending from said second conductor end, an RF energy field is set up across said transmission line notch portion and said conductor notch portion, said conductive member at said second transmission line end being electrically connected to said second conductor end so that said transmission line notch portion of said conductive layer and said conductor notch portion of said conductor form an RF active notch structure for radiating said RF energy field in a direction away from said RF active notch structure and for transitioning the characteristic impedance of said transmission line to that of air, said first and second antenna elements being positioned generally at right angles to each other with said RF active notch structures adjacent.

12. The antenna as defined in claim 11 wherein each antenna element includes:

dielectric means for supporting said transmission line and said conductor in a planar relationship, said planar relationship of each antenna element being at right angles to each other.

13. The antenna as defined in claim 11 wherein said first and second antenna elements are insulated from each other.

14. The antenna as defined in claim 11 wherein said conductive layers of said antenna elements have an effective electrical outer diameter and said conductors of said antenna elements have a similar effective electrical outer diameter.

15. The antenna as defined in claim 11 wherein said conductive layer of each antenna element is isolated from said first conductor end near said first transmission line end.

16. The antenna as defined in claim 11 wherein said transmission line notch portion and said conductor notch portion of each of said antenna elements is curved, extending from said second transmission line end and said second conductor end to smoothly transition the impedance of said transmission line to that of air.

17. The antenna as defined in claim 11 wherein said transmission line notch portion and said conductor notch portion of each of said antenna elements are formed in generally similar curves extending from said second transmission line end and said second conductor end, and wherein said RF active notch structure of each of said antenna elements has:

a center line generally oriented equally spaced from said transmission line notch portion and said conductor notch portion, said center lines of said antenna elements being coextensive.

18. The antenna as defined in claim 11 wherein said transmission line of each of said antenna elements has:

at least one distributed ferrite load there about at said transmission line connecting portion thereof, and wherein said conductor of each of said antenna elements has:

at least one distributed ferrite load there about at said conductor connecting portion thereof.

19. The antenna as defined in claim 11 wherein said conductive layer of said transmission line notch portion of each of said antenna elements includes:

at least one conductive transmission line planar sheet having:

a first inner edge defining a transmission line portion of said RF active notch structure, wherein said conductive member of said transmission line notch portion of each of said antenna elements includes:

at least one conductive planar strip positioned parallel to said at least one conductive transmission line planar sheet and closely spaced therefrom, and wherein said conductor notch portion of each of said antenna elements includes:

at least one conductive conductor planar sheet having:

a second inner edge generally facing said first inner edge and defining a conductor portion of said RF active notch structure.

20. The antenna as defined in claim 11 wherein each of said antenna elements further includes:

a planar dielectric layer for supporting said transmission line and said conductor in a plane, said planar dielectric layer having:

opposite parallel sides, and wherein said conductive layer of said transmission line notch portion of each of said antenna elements is a covering including:

a pair of conductive transmission line planar sheets positioned on said opposite parallel sides of said planar dielectric layer, each conductive transmission line planar sheet having:

a first inner edge defining a transmission line portion of said RF active notch structure, wherein said conductive member of said transmission line notch portion of each of said antenna elements includes:

at least one conductive planar strip parallel to said conductive transmission line planar sheets and closely spaced therebetween, and wherein said conductor notch portion of each of said antenna elements include:

a pair of conductive conductor planar sheets positioned on said opposite parallel sides of said planar dielectric layer, each conductive conductor planar sheet having:

a second inner edge generally facing said first inner edge and defining a conductor portion of said RF active notch structure.

21. The antenna as defined in claim 11 including:

a plurality of said first and second antenna elements formed into an array.

22. The antenna as defined in claim 11 further including:

a control network connected to said first transmission line ends to control the polarity of the antenna pattern of said antenna.

23. An antenna element (30) including:

a coaxial cable (36) having:

a conductive sheath (60);

a center conductor (58);

a first cable end (34) for connection to RF means;

a second cable end (72);

a cable connecting portion (42 & 46) extending from said first cable end; and a cable notch portion (46) extending from said second cable end to said cable connecting portion; and a wire (50) having:

a first wire end (78);

a second wire end (72);

a wire connecting portion (52 & 54) extending from said first wire end; and a wire notch portion (56) extending from said second wire end to said wire connecting portion, said coaxial cable notch portion is shaped in a first curve extending from said second coaxial cable end and said wire notch portion is shaped in a second curve that is generally a mirror image of said first curve extending from said second wire end, an RF energy field is set up across said coaxial cable notch portion and said wire notch portion, said center conductor at said second cable end being electrically connected to said second wire end so that said cable notch portion of said coaxial cable and said wire notch portion of said wire form an RF active notch structure for radiating said RF energy field in a direction away from said RF active notch structure and for transitioning the characteristic impedance of said coaxial cable to that of air.

24. The antenna element as defined in claim 23 wherein said RF active notch structure includes:

a center line (33); and wherein said cable notch portion (228) and said wire notch portion (230) are each spiraled in the same direction about said center line.

25. The antenna element as defined in claim 23 further including:

dielectric means for supporting said coaxial cable and said wire generally in a plane.

26. The antenna element as defined in claim 24 wherein said conductive sheath has an effective electrical outer diameter and said wire has a similar effective electrical outer diameter.

27. The antenna element as defined in claim 26 wherein said cable notch portion and said wire notch portion are shaped to exponentially transition the characteristic impedance of said coaxial cable to that of air.

28. The antenna element as defined in claim 26 wherein said RF active notch structure has:

a center line generally oriented equally spaced from said cable notch portion and said wire notch portion, said cable connecting portion having:

a first shape;

a first cable subportion (42) extending from said first cable end outwardly perpendicular to said center line; and a second cable subportion (44) connected to said first cable subportion spaced from said first cable end and extending parallel to said center line of said notch portion thereof, and said wire connecting portion having:

a second shape that mirror images said first shape;

a first wire subportion (52) extending adjacent said first wire end outwardly perpendicular to said center line; and a second wire subportion (54) connected to said first wire subportion spaced from said first wire end and extending parallel to said center line of said notch portion thereof.

29. The antenna element as defined in claim 28 wherein said coaxial cable has:

at least one distributed ferrite load there about at said cable connecting portion thereof, and wherein said wire has:

at least one distributed ferrite load there about at said wire connecting portion thereof.

30. The antenna element as defined in claim 29 wherein said conductive sheath of said cable notch portion includes:

at least one conductive planar sheet adjacent said cable notch portion having:

a first edge defining a portion of said RF active notch structure, and wherein said wire notch portion includes:

at least one conductive conductor planar sheet having:

a second edge generally facing said first edge and defining a portion of said RF active notch structure.

31. The antenna element as defined in claim 23 wherein said cable notch portion and said wire notch portion have a small difference in electrical length.

32. The antenna element as defined in claim 31 wherein said conductive sheath is isolated from direct electrical connection with said center conductor at said second cable end.

* * * * *